US010542603B2

(12) United States Patent
Pham

(10) Patent No.: US 10,542,603 B2
(45) Date of Patent: Jan. 21, 2020

(54) WEARABLE LIGHT-EMITTING APPARATUS AND CONTROL METHOD

(71) Applicant: Huynh Phong Pham, Ho Chi Minh (VN)

(72) Inventor: Huynh Phong Pham, Ho Chi Minh (VN)

( * ) Notice: Subject to any disclaimer, the term of this patent is extended or adjusted under 35 U.S.C. 154(b) by 9 days.

(21) Appl. No.: 15/773,875

(22) PCT Filed: Sep. 5, 2016

(86) PCT No.: PCT/IB2016/055304

§ 371 (c)(1),
(2) Date: May 4, 2018

(87) PCT Pub. No.: WO2017/077405

PCT Pub. Date: May 11, 2017

(65) Prior Publication Data

US 2018/0376561 A1 Dec. 27, 2018

(30) Foreign Application Priority Data

Nov. 4, 2015 (VN) ..... 2-2015-00340

(51) Int. Cl.
*H05B 33/08* (2006.01)
*F21V 23/04* (2006.01)
(Continued)

(52) U.S. Cl.
CPC ..... *H05B 33/0863* (2013.01); *F21V 23/003* (2013.01); *F21V 23/02* (2013.01);
(Continued)

(58) Field of Classification Search
CPC ..... A41D 19/0024; A44C 5/0007; A61B 2560/0209; A61B 2560/0228; A61B 5/0022; A61B 5/0205; A61B 5/02055; A61B 5/021; A61B 5/02438; A61B 5/0261; A61B 5/0402; A61B 5/04085; A61B 5/0472; A61B 5/0478; A61B 5/0533; A61B 5/0816; A61B 5/14551; A61B 5/486;
(Continued)

(56) References Cited

U.S. PATENT DOCUMENTS 8,477,986 B1 7/2013 Kiser
9,013,281 B2 4/2015 Vorhies et al.
(Continued)

OTHER PUBLICATIONS

International Search Report and Written Opinion, PCT/IB2016/055304, 8 pages (dated Mar. 14, 2017).

*Primary Examiner* — Renan Luque
(74) *Attorney, Agent, or Firm* — Foley & Lardner LLP

(57) ABSTRACT

The present invention refers to a wearable light-emitting device that can be used for safety warnings, cheering, and light show performing. The invention also refers to a control method that allows the wearer to perform different commands by waving her/his hand in left or right, up or down, forward or backward directions. In addition, the control method allows the wearer to turn off/on the light and change its color with simple actions such as closing and opening her/his hand. Furthermore, the invention allows the wearer to easily handle other objects or perform grasping tasks while wearing this device.

7 Claims, 2 Drawing Sheets

(51) Int. Cl.

| | |
|---|---|
| ***F21V 23/00*** | (2015.01) |
| ***F21V 23/02*** | (2006.01) |
| ***G08B 5/00*** | (2006.01) |
| ***F21W 121/06*** | (2006.01) |
| ***F21Y 113/13*** | (2016.01) |
| ***F21Y 115/10*** | (2016.01) |
| ***F21W 111/10*** | (2006.01) |

(52) U.S. Cl.
CPC ..... *F21V 23/0471* (2013.01); *G08B 5/004* (2013.01); *H05B 33/0842* (2013.01); *H05B 33/0872* (2013.01); *F21W 2111/10* (2013.01); *F21W 2121/06* (2013.01); *F21Y 2113/13* (2016.08); *F21Y 2115/10* (2016.08)

(58) Field of Classification Search
CPC ..... A61B 5/6803; A61B 5/681; A61B 5/7203; A61B 5/721; A61B 5/7221; A61B 5/725; A61B 5/7264; A61B 5/7275; A61B 5/7282; A61B 5/7405; A61B 5/7425; A61B 5/7455; A61B 5/746; A61B 5/7475; G06F 1/163; G06F 1/1632; G06F 1/1635; G06F 1/1698; G06F 1/26; G06F 2200/1637; G06F 3/014; G06F 3/016; G06F 3/017; G06K 9/00335; G06K 9/00355; G06Q 20/325; G08B 21/02; G09G 3/20; H02J 7/0027; H02J 7/0042; H02J 7/0047; H02J 7/025; H04B 1/385; H04B 2001/3861; H04M 1/0202; H04M 1/0254; H04M 1/04; H04M 1/05; H04M 1/57; H04M 1/7253; H04M 2250/12; H04M 2250/22; Y10S 439/953; Y10T 24/3407; H05B 33/0863; H05B 33/0872; F21V 23/003; F21V 23/02; F21V 23/0471; F21W 2111/10; F21W 2121/06; F21Y 2113/13; F21Y 2115/10
See application file for complete search history.

(56) References Cited

U.S. PATENT DOCUMENTS

| | | | | |
|---|---|---|---|---|
| 2008/0218996 | A1* | 9/2008 | Galloway | A41D 19/0157 362/103 |
| 2008/0225514 | A1* | 9/2008 | Stokes | A41D 19/0157 362/103 |
| 2013/0119255 | A1* | 5/2013 | Dickinson | G04G 21/00 250/340 |
| 2013/0262298 | A1* | 10/2013 | Morley | H04M 1/05 705/39 |
| 2013/0271964 | A1* | 10/2013 | Rife | A44C 15/0015 362/104 |
| 2013/0328842 | A1* | 12/2013 | Barnhoefer | G09G 3/3406 345/207 |
| 2014/0265906 | A1 | 9/2014 | Lim et al. | |
| 2015/0253858 | A1* | 9/2015 | Koukoumidis | G06F 3/0488 345/156 |
| 2016/0246369 | A1* | 8/2016 | Osman | A63F 13/212 |

* cited by examiner

WEARABLE LIGHT-EMITTING APPARATUS AND CONTROL METHOD

CROSS-REFERENCE TO RELATED APPLICATIONS

This application is a National Stage Application of PCT/IB2016/055304, filed Sep. 5, 2016, which claims the benefit of and priority to Vietnam Patent Application No. 2-2015-00340, filed Nov. 4, 2015, the entire contents of which are incorporated herein by reference.

FIELD OF THE INVENTION

The invention pertains generally to wearable light-emitting apparatus. More specifically, the invention relates to a wearable light-emitting apparatus that can be used for safety warnings, cheering at sporting or concert events, or light show performing.

BACKGROUND ART

The introduction of light-emitting diodes (LED) has ushered in a new era for light-emitting devices. LED lights, thanks to their advantages of small size, long life-time, low power consumption and low heat dissipation, have replaced incandescent lamps in many wearable light-emitting devices. Furthermore, LEDs provide more operating modes over chemiluminescence substrates (used in glow sticks) which are short-term light-sources and can be used only once.

A variety of wearable light-emitting devices used for safety warnings, cheering at sporting or concert events, or light show performance currently exist. These devices can be classified into two groups:

Group 1: wearable light-emitting devices that are controlled by a remote control center.

Group 2: wearable light-emitting devices that are controlled by the wearer.

Wearable light-emitting devices of group 1 are usually used in events with a large audience such as sports competitions or music concerts. Each device typically comprises a power supply unit (battery), a control unit, a signal transmitter/receiver, and a few LED lights. They are usually introduced in the form of light-emitting bracelets that are worn on the wrist. These bracelets are wirelessly driven by a remote control center via radio (Xyloband, Ripple-light) or infrared (PixMob, SLC). The advantage of these devices is that they allow creating beautiful lighting effects at the macro level. However, the possible control of the wearer on these devices is limited to turning on and turning off the device, not the control of light and color effects. Moreover, the use of these devices always requires a control center. This makes operating such devices more complex. The mobility of wearers is restrained within the coverage of the control center.

Wearable light-emitting devices of group 2 are usually used by individuals for the purpose of safety warnings or light show performance. Each device typically comprises a power supply unit (battery), a control unit, a push button, and a few LED lights. They can be introduced in the form of light-emitting bracelets (sub-group 2a), glowing gloves (sub-group 2b), or small light-emitting devices that will be worn on the fingertips (sub-group 2c). For devices of sub-groups 2a and 2b, the push button allows to switch between pre-programmed modes: light off, blinking light, solid light. The advantage of these devices is their simple control: pressing a button. Their inconvenience, however, is that they usually require the wearer to use her/his non-wearing hand to manipulate the button. For example, the invention of Kiser (U.S. Pat. No. 8,477,986 on Jul. 2, 2013) does not allow the wearer control the device using the wearing hand. To overcome this drawback, Zackess glove (U.S. Pat. No. 9,013,281 on Apr. 21, 2015) is designed with a switch mechanism where a first contact assembly locates on a thumb and a second contact assembly locates on an index finger of the glove. This allows the wearer to control the device by simply moving the thumb of her/his wearing hand. However, this device only allows the user to turn on and off the blinking light with a predefined frequency. It is impossible to manipulate the light and color effects.

For devices in sub-group 2c (for example, Emazinglights of Brian Lim and Montes de Oca and Ramiro, US Patent Application Publication No. 2014/0265906 on Sep. 18, 2014; light-emitting devices of Futuristiclights), the wearer can use the wearing hand to press the on-device-button to switch between pre-programmed display modes because the devices are worn on the fingertips. These devices have however a few drawbacks. First, because the devices must be worn on the fingertips, the wearer should always use gloves to keep these devices in position. This makes it difficult to hold other objects or perform other grasping tasks while using these devices. The second drawback of these devices is not allowing the wearer to control the on/off time of the LED beyond the preprogrammed modes. Some devices in this sub-group have integrated motion sensors enabling automatic change of display modes when the wearer varies her/his hand moving speed. For example, an accelerometer sensor allows the LED to turn on when there is motion and the LED to turn off when there is no motion. This enables users to fully control the on/off time of the LED. However, the downside of this solution is that it does not allow the wearer to turn on/off the LED independently with the movement of the device.

The device which is considered to be the closest to this invention is "LED 3D printing wristbands with accelerometer sensor" by Caleb Kraft (3D-Printed RGB LED Bracelet Uses Accelerometer (called "3D-printing LEDs bracelet"). The device includes a power supply unit (battery), a microcontroller, an accelerometer sensor and a few LED lights. The bracelet allows the wearer to interact with it with shaking motions of the hand. When no motion detected, the color of the LEDs will gradually change following a predetermined color sequence. When there are shaking motions in a short time, the LEDs will skip a few colors in the sequence. The advantage of this device is that it allows the wearer to interact with the bracelet by simple actions such as a shaking motion. However, like many devices mentioned above, this bracelet does not allow the wearer to control the on/off time of the LEDs. In addition, because the interaction between the wearer and 3D-printing LEDs bracelet is shaking, any fast motion in any direction with a sufficient intensity can lead to a result that the LEDs will skip a few colors. That means there will be no difference among shaking motions in left, right, up or down directions. Another drawback of 3D-printing LEDs bracelet is not allowing the wearer to move her/his hand with the desired speed while maintaining a display program.

This context makes necessary introducing a wearable light-emitting device and a control method that can overcome the disadvantages of the devices mentioned above.

BACKGROUND OF INVENTION

The present invention relates to a wearable light-emitting device and a control method that can:

Allow the wearer to control the device without having to set up a control center.

Allow the wearer to interact with the device with her/his wearing hand.

Allow the wearer to easily handle other objects or perform grasping tasks while wearing this device.

Allow the wearer to fully control the off/on time of the light independently with the movement of the device.

Allow the wearer to give different commands when shaking her/his hand in left or right, up or down, and forward or backward directions.

The present invention refers to a wearable light-emitting device that can be worn on the user's hand. This device comprises:

one or more multi-color LEDs which are disposed on the dorsal side of the device;

one or more multi-color LEDs which are disposed on the palm side of the device;

one or more proximity sensors which are disposed on the palm side of the device, pointing outward for measuring the distance to nearby objects;

a control button for turning the device OFF, ON, and receiving control commands from the user;

a micro-controller for processing signals from the proximity sensors, the control button, and controlling the multi-color LEDs;

one or more electronic circuits for connecting all electronic components; and a power supply unit for powering all electronic components.

In one embodiment, the power supply unit comprises from one to three button batteries.

In another embodiment, the wearable light-emitting device comprises one or more accelerometer sensors for tracking the movement of user's wearing hand.

In some embodiments, the mentioned device comprises:

one electronic circuit for connecting all electronic components disposed on the dorsal side of the device;

one electronic circuit for connecting all electronic components disposed on the palm side of the device; and cables for connecting these two electronic circuits.

In yet further embodiments, the mentioned device comprises:

many electronic circuits, wherein each circuit comprises at least one electronic component; and cables for connecting these electronic circuits.

The present invention also refers to a control method of the said wearable light-emitting device. This control method comprises:

presenting objects at a distance between 0 and 5 cm to the palm side of the wearable light-emitting device (activating the proximity sensors) for turning off all multi-color LEDs on the device;

removing the objects or moving the objects further than 5 cm from the palm side of the wearable light-emitting device (deactivating the proximity sensors) for controlling the multi-color LEDs with one of preset display programs.

In accordance with one embodiment of the control method, pressing the control button on the device for less than 1 second and then releasing the control button allow changing the color of the multi-color LEDs to the next color of a predetermined color sequence.

In accordance with another embodiment of the control method, performing within 1 second two consecutive actions of presenting objects at a distance between 0 and 5 cm to the palm side of the wearable light-emitting device (activating the proximity sensors), then removing these objects or moving these objects further than 5 cm from the palm side of the device (deactivating the proximity sensors) allows changing the color of the multi-color LEDs to the next color in a predetermined color sequence.

In some embodiments of the control method, shaking the device along the axis perpendicular to the palm's plane allows changing the color of the multi-color LEDs to the next color in a predetermined color sequence.

In yet further embodiments of the control method, shaking the device along the axis parallel to the palm's plane and perpendicular to the extended fingers creates an effect of a moving light source along this axis.

In some other embodiments of the control method, shaking the device along the axis parallel to the extended fingers allows changing the blinking frequency of the multi-color LEDs to the next frequency in a predetermined frequency sequence.

BRIEF DESCRIPTION OF THE DRAWINGS

FIG. 4*a* and FIG. 4*c* show that the multi-color LEDs are off when an object is presented at a distance between 0 and 5 cm to the palm side of the wearable light-emitting device (activating the proximity sensors). FIG. 4*b* and FIG. 4*d* show that the multi-color LEDs are controlled with one of preset display programs when the object is removed or presented at a distance further than 5 cm to the palm side of the wearable light-emitting device (deactivating the proximity sensors).

DETAILED DESCRIPTION OF THE INVENTION

In order to achieve the above purposes, the present invention proposes a wearable light-emitting device comprising:

one or more multi-color LEDs which are disposed on the dorsal side of the device;

one or more multi-color LEDs which are disposed on the palm side of the device;

one or more proximity sensors which are disposed on the palm side of the device, pointing outward for measuring the distance to nearby objects;

a control button for turning the device OFF, ON, and receiving control commands from the user;

a micro-controller for processing signals from the proximity sensors, the control button, and controlling the multi-color LEDs;

one or more electronic circuits for connecting all electronic components; and a power supply unit for powering all electronic components.

In one embodiment, the power supply unit comprises from one to three button batteries.

In another embodiment, the wearable light-emitting device comprises one or more accelerometer sensors for tracking the movement of user's wearing hand.

In some embodiments, the said wearable light-emitting device comprises:

one electronic circuit for connecting all electronic components disposed on the dorsal side of the device;

one electronic circuit for connecting all electronic components disposed on the palm side of the device; and cables for connecting these two electronic circuits.

In yet further embodiments, the said wearable light-emitting device comprises:

many electronic circuits, wherein each circuit comprises at least one electronic component; and cables for connecting these electronic circuits.

Figure 1:
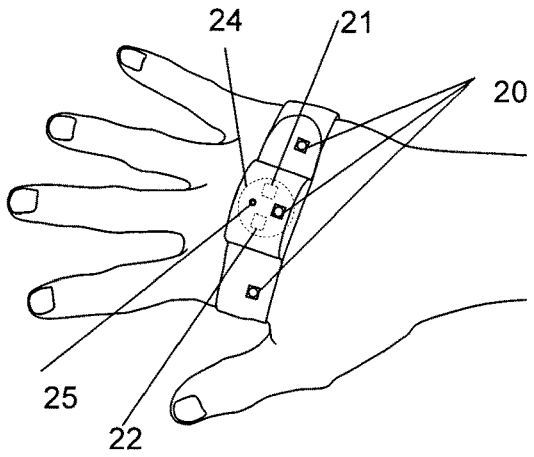
FIG. 1 is a drawing of the wearable light-emitting device (dorsal side).
Figure 2:
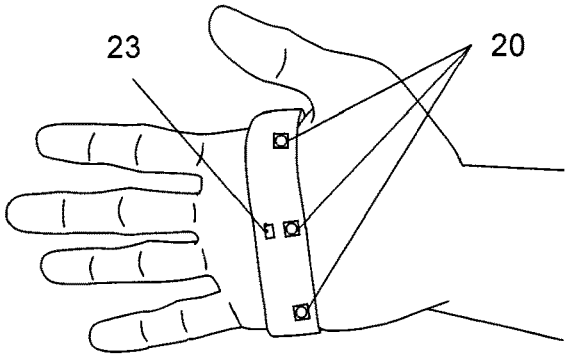
FIG. 2 is a drawing of the wearable light-emitting device (palm side).

With initial reference to FIG. 1 and FIG. 2, the said wearable light-emitting device comprises many multi-color LEDs 20, a micro-controller 21, one or more accelerometer sensors 22, more or more proximity sensors 23, a power supply unit 24 (can comprise from one to three button batteries), and a control button 25. These electronic components can be disposed on a flexible printed circuit board or many printed circuit boards which are connected by cables to ensure that the said device is flexible and bendable.

The power supply unit 24 supplies energy to all electronic components of the wearable light-emitting device. The micro-controller 21 will analyze in real time the signals from accelerometer sensors 22, proximity sensors 23, and control button 25. The micro-controller 21 will then set the display program and the color of the multi-color LEDs 20.

The control method of the wearable light-emitting device is presented in detail as below:

When the wearable light-emitting device is OFF (all multi-color LEDs 20 are off, even when there is no object in front of the proximity sensors 23), pressing the control button 25 for less than 1 second and then releasing this button allow turn ON the said device.

Figure 4A:
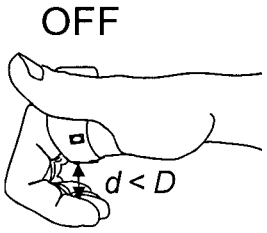
FIG. 4*a*, FIG. 4*b*, FIG. 4*c* and FIG. 4*d* are drawings showing the control method using proximity sensors.
Figure 4B:
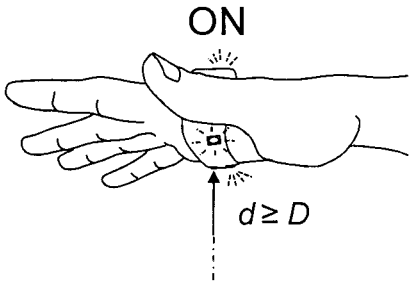
Figure 4C:
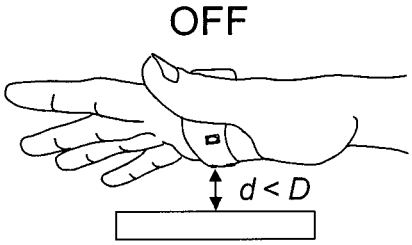
Figure 4D:
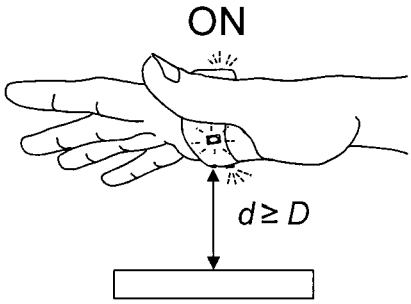

When the wearable light-emitting device is ON, the proximity sensors 23 continuously measure the distance d between nearby objects and the palm side of the wearable light-emitting device. When d is smaller than the predefined threshold D, all multi-color LEDs 20 on the wearable light-emitting device are turned off (FIG. 4*a* and FIG. 4*c*). In the present invention, D is equal to 5 cm. When d is equal to or greater than D, i.e. 5 cm, the multi-color LEDs 20 are controlled with one of preset display programs (FIG. 4*b* and FIG. 4*d*). This solution allows the user to turn off/on the light of the multi-color LEDs 20 simply by closing/opening her/his hand.

When the wearable light-emitting device is ON, pressing the control button 25 for less than 1 second and then releasing this button allow changing the color of the multi-color LEDs 20 to the next color of a predetermined color sequence.

When the wearable light-emitting device is ON, by performing within 1 second two consecutive actions of presenting objects at the distance of 5 cm or closer to the palm side of the wearable light-emitting device (activating the proximity sensors 23), then removing or moving these objects further than 5 cm from the palm side of the device (deactivating the proximity sensors 23), the user can change the color of the multi-color LEDs 20 to the next color in a predetermined color sequence.

Figure 3:
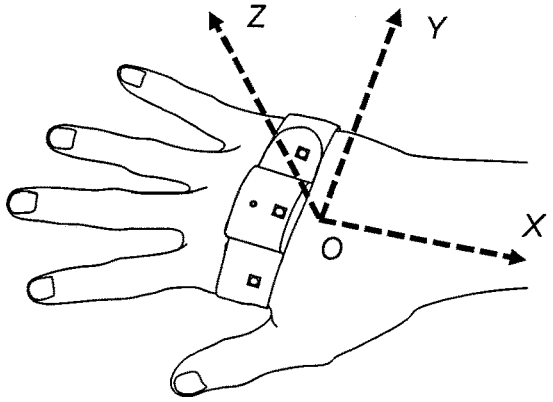
FIG. 3 is a drawing showing the control method using accelerometer sensors.

When the wearable light-emitting device is ON, shaking the device along the axis perpendicular to the palm's plane (OZ axis in FIG. 3) allows changing the color of the multi-color LEDs 20 to the next color in a predetermined color sequence.

When the wearable light-emitting device is ON, shaking the device along the axis parallel to the palm's plane and perpendicular to the extended fingers (OY axis in FIG. 3) creates an effect of a moving light source along this axis.

When the wearable light-emitting device is ON, shaking the device along the axis parallel to the extended fingers (OX axis in FIG. 3) allows changing the blinking frequency of the multi-color LEDs 20 to the next frequency in a predetermined frequency sequence.

When the wearable light-emitting device is ON, press and hold the control button 25 for more than 5 seconds allow turning OFF the device (all multi-color LEDs 20 are off, even when there is no object in front of the proximity sensors 23).

Example of Implementation

A wearable light-emitting device comprises 8 RGB LEDs (4 RGB LEDs disposed on the dorsal side of the device and 4 RGB LEDs disposed on the palm side of the device), one micro-controller, one proximity sensor, one power supply unit, and one control button. These components are disposed on a flexible printed circuit board or many printed circuit boards which are connected by cables.

The power supply unit, comprising 2 button batteries, supplies energy to all electronic components of the wearable light-emitting device. The micro-controller analyses in real time the signals from the proximity sensor and the control button, and sets the display program and the color of the RGB LEDs.

When the wearable light-emitting device is OFF (all RGB LEDs are off, even when there is no object in front of the proximity sensor), pressing the control button for less than 1 second and then releasing this button allow turn ON the said device.

When the wearable light-emitting device is ON, presenting objects at a distance between 0 and 5 cm to the palm side of the wearable light-emitting device (activating the proximity sensor) for turning off the light of all RGB LEDs on the said device. Removing these objects or moving these objects further than 5 cm from the palm side of the wearable light-emitting device (deactivating the proximity sensor) for controlling the RGB LEDs with one of the two preset display programs: solid light and blinking light.

When the wearable light-emitting device is ON, pressing the control button for less than 1 second and then releasing this button allow changing the color of the RGB LEDs to the next color of a predetermined color sequence: red, green, blue, white, and yellow.

When the wearable light-emitting device is ON, by performing within 1 second two consecutive actions of presenting objects at a distance between 0 and 5 cm to the palm side of the wearable light-emitting device (activating the proximity sensor), then removing or moving these objects further than 5 cm from the palm side of the device (deactivating the proximity sensor), the user can change the color of the RGB LEDs to the next color in a predetermined color sequence: red, green, blue, white, and yellow.

When the wearable light-emitting device is ON, press and hold the control button for more than 5 seconds allow turning OFF the device (all RGB LEDs are off, even when there is no object in front of the proximity sensor).

The invention claimed is:

1. A method of operating a wearable light-emitting device, wherein the wearable light-emitting device comprises:

one or more first multi-color LEDs disposed on a dorsal side of the device;

one or more second multi-color LEDs disposed on a palm side of the device;

wherein the palm side of the device has a first edge and a second edge, the one or more second multi-color LEDs disposed on the palm side of the device being closer to the first edge than to the second edge;

one or more proximity sensors disposed on the palm side of the device and positioned closer to the second edge than the first edge, the one or more proximity sensors configured to detect the presence of one or more objects within a proximity distance;

one or more controls configured to turn the device OFF, ON, and to receive control commands from a user;

a micro-controller configured to receive and process signals from the one or more proximity sensors, the one or more controls, and to control the first and second multi-color LEDs; and one or more electronic circuits configured to connect one or more of the micro-controller, the one or more proximity sensors, the one or more controls, and the one or more of the first and the second multi-color LEDs disposed on the dorsal side or on the palm side of the device;

wherein the method further comprises:

presenting one or more objects at a distance between 0 cm and 5 cm to the palm side of the wearable light-emitting device;

activating, in response to one or more of the proximity sensors detecting the one or more of the objects being at the distance between 0 cm and 5 cm, by changing the state of one or more of the first or the second multi-color LEDs disposed on the dorsal side or on the palm side of the device;

removing the one or more objects to further than 5 cm from the palm side of the wearable light-emitting device; and deactivating, in response to one or more of the proximity sensors no longer detecting the one or more of the objects being at the distance between 0 cm and 5 cm, by changing the state of one or more of the first and second multi-color LEDs disposed on the dorsal side or on the palm side of the device.

2. The control method of claim 1, the method further comprising:

pressing one or more of the controls configured as a control button on the device for less than 1 second; and releasing the control button to change the color of the multi-color LEDs to the next color of a predetermined color sequence.

3. The control method of claim 1, the method further comprising:

performing two consecutive actions within one second of positioning objects at a proximity distance between 0 cm and 5 cm from the palm side of the wearable light-emitting device to activate one or more of the proximity sensors;

removing these objects, or moving these objects further than 5 cm from the palm side of the device, to deactivate one or more of the proximity sensors; and changing the color of one or more of the multi-color LEDs to a next color in a predetermined color sequence.

4. The control method of claim 1, further comprising:

shaking the device along an axis perpendicular to the plane of the palm of the device to change the color of the multi-color LEDs to the next color in a predetermined color sequence.

5. The control method of claim 1, further comprising:

shaking the device along an axis parallel to the plane of the palm of the device to perpendicular to extended fingers of the device to create a moving light source effect along the axis.

6. The control method of claim 1, further comprising:

shaking the device along an axis parallel to extended fingers of the device to change the blinking frequency of light from a first frequency and in a predetermined frequency sequence.

7. A method of operating a wearable light-emitting device, wherein the wearable light-emitting device comprises:

one or more first multi-color LEDs disposed on a dorsal side of the device;

one or more second multi-color LEDs disposed on a palm side of the device;

wherein the palm side of the device has a first edge and a second edge, the one or more second multi-color LEDs disposed on the palm side of the device being closer to the first edge than to the second edge;

one or more proximity sensors disposed on the palm side of the device and positioned closer to the second edge than the first edge, the one or more proximity sensors configured to detect the presence of one or more objects within a proximity distance;

one or more controls configured to turn the device OFF, ON, and to receive control commands from a user;

one or more accelerometer sensors configured to track movement of the user's hand that is utilizing the device;

a micro-controller configured to receive and process signals from the one or more proximity sensors, the one or more controls, and the one or more accelerometer sensors, and to control the first and second multi-color LEDs; and one or more electronic circuits configured to connect one or more of the micro-controller, the one or more proximity sensors, the one or more controls, the one or more accelerometer sensors, and the one or more of the first and the second multi-color LEDs disposed on the dorsal side or on the palm side of the device;

wherein the method further comprises:

presenting one or more objects at a distance between 0 cm and 5 cm to the palm side of the wearable light-emitting device;

activating, in response to one or more of the proximity sensors detecting the one or more of the objects being at the distance between 0 cm and 5 cm, by changing the state of one or more of the first or the second multi-color LEDs disposed on the dorsal side or on the palm side of the device;

removing the one or more objects to further than 5 cm from the palm side of the wearable light-emitting device; and deactivating, in response to one or more of the proximity sensors no longer detecting the one or more of the objects being at the distance between 0 cm and 5 cm, by changing the state of one or more of the multi-color LEDs disposed on the dorsal side or on the palm side of the device.

* * * * *